US007941983B2

(12) United States Patent
Wheeler

(10) Patent No.: US 7,941,983 B2
(45) Date of Patent: May 17, 2011

(54) APPARATUS AND METHODS OF FORMING A CURVED STRUCTURE

(75) Inventor: Frank L. Wheeler, Oklahoma City, OK (US)

(73) Assignee: Flex-Ability Concepts, L.L.C., Oklahoma City, OK (US)

( * ) Notice: Subject to any disclaimer, the term of this patent is extended or adjusted under 35 U.S.C. 154(b) by 1176 days.

(21) Appl. No.: 11/601,306

(22) Filed: Nov. 17, 2006

(65) Prior Publication Data

US 2008/0115427 A1 May 22, 2008

(51) Int. Cl.
*E04H 1/00* (2006.01)

(52) U.S. Cl. ..... 52/241; 52/223.9

(58) Field of Classification Search ..... 52/86, 241, 52/108, 223.9, 211, 212, 102, 71; 47/33
See application file for complete search history.

(56) References Cited

U.S. PATENT DOCUMENTS

| | | | | |
|---|---|---|---|---|
| 348,598 | A * | 9/1886 | Strickland | 52/102 |
| 689,894 | A | 12/1901 | Lutz | |
| 1,170,188 | A | 2/1916 | Ramussen et al. | |
| 2,419,321 | A | 4/1947 | Lopes | |
| 2,635,281 | A | 4/1953 | Feldberg | |
| 2,751,634 | A * | 6/1956 | Washington | 446/487 |
| 3,053,358 | A | 9/1962 | Gross | |
| 3,260,022 | A | 7/1966 | Guyer et al. | |
| 3,295,269 | A * | 1/1967 | Schuster | 52/108 |
| 3,505,714 | A | 4/1970 | Boileau | |
| 3,999,352 | A | 12/1976 | Doke | |
| 4,263,761 | A | 4/1981 | Kristoff | |
| RE31,234 | E | 5/1983 | Jureit et al. | |
| 4,483,120 | A | 11/1984 | Gottlieb | |
| 4,496,100 | A | 1/1985 | Schwager et al. | |
| 4,544,094 | A | 10/1985 | Scholey | |
| 4,562,683 | A | 1/1986 | Gottlieb | |
| 4,593,710 | A | 6/1986 | Stafford et al. | |
| 4,631,894 | A | 12/1986 | Jerila | |
| 4,773,503 | A | 9/1988 | Purkapile | |
| 4,869,018 | A * | 9/1989 | Scales et al. | 47/33 |
| 4,887,397 | A * | 12/1989 | Peterson | 52/86 |
| 4,894,962 | A * | 1/1990 | Conn | 52/86 |
| 5,094,059 | A | 3/1992 | Ganescu | |
| 5,119,587 | A * | 6/1992 | Waltz | 47/33 |
| 5,121,831 | A * | 6/1992 | Fesler | 198/853 |
| 5,168,678 | A * | 12/1992 | Scott et al. | 52/102 |

(Continued)

FOREIGN PATENT DOCUMENTS

EP 1 464 770 A1 10/2004

OTHER PUBLICATIONS

The Flex Trim Group entitled "The Flex Track System"—1 page.

(Continued)

*Primary Examiner* — Basil Katcheves
(74) *Attorney, Agent, or Firm* — McAfee & Taft

(57) ABSTRACT

The current invention provides a runner for constructing curved surfaces. The runner has at least two sections with each section having at least two layers. The layers used to prepare the sections are substantially identical. However, when assembled to form a section one layer is reversed compared to another layer. Alternatively, each section may be integrally formed. Adjacent sections are pivotal with respect to one another until secured on a desired radius. The runner of the current invention is suitable for constructing curved walls, archways and other curved structures.

11 Claims, 13 Drawing Sheets

U.S. PATENT DOCUMENTS

| | | | | | |
|---|---|---|---|---|---|
| 5,186,574 | A | * | 2/1993 | Tavares | 404/73 |
| D338,377 | S | * | 8/1993 | Scott et al. | D8/1 |
| D338,812 | S | * | 8/1993 | Scott et al. | D8/1 |
| 5,259,154 | A | * | 11/1993 | Lilley | 47/33 |
| D346,726 | S | * | 5/1994 | Scott et al. | D8/1 |
| D372,991 | S | * | 8/1996 | Ramsey | D25/164 |
| 5,553,961 | A | | 9/1996 | Olden | |
| 5,819,492 | A | | 10/1998 | Konicek | |
| 6,625,942 | B1 | | 9/2003 | Wheeler | |
| 6,634,152 | B1 | | 10/2003 | Pilkinton | |
| 6,944,998 | B1 | * | 9/2005 | King | 52/314 |
| 7,634,874 | B2 | * | 12/2009 | Lucas | 52/108 |

OTHER PUBLICATIONS

Ray Clark; Construction Reference Manual entitled "Commercial Metal Stud Framing"—1999; pp. 10-15.

Flex-Ability Concepts Seminar entitled "Creating Custom Curves: Adding Interest to Architectural Designs" 2004.

Brochure of United States Gypsum Company Entitled "Interior Remodeling Systems" (1987).

* cited by examiner

APPARATUS AND METHODS OF FORMING A CURVED STRUCTURE

BACKGROUND OF THE INVENTION

This invention relates generally to the field of construction and more particularly, but not by way of limitation, to methods and apparatus for forming curved structures, such as curved walls, archways, barrel ceilings and round columns.

Typically, straight wall construction uses a runner attached to the floor structure and a corresponding runner attached to the ceiling structure (or free floating) with studs positioned between and attached to the runners. The runners and studs form a structural frame suitable for supporting gypsum board, such as SHEETROCK™, or other wall covering. Construction of other straight line structures relies on these same principles. Common construction practices use wooden 2×4's and 2×6's (approximate dimensions of boards in inches) to form the runners and studs.

These standard materials and methods are suitable for a major portion of most construction, however, curved structures, such as curved walls, archways, barrel ceilings and round columns are frequently desired for their architectural styling. While the principles for constructing curved structures are much the same as those for constructing straight structures, formation of such structures typically requires significantly more cuts in the runners and studs to form the desired radius. As a result, several track designs formed from sheet metal have been developed to reduce the amount of labor and waste associated with the construction of curved structures. While the sheet metal runners have been accepted as improvements over standard construction techniques, many are unwieldy and are difficult to position and retain in a desired position. Additionally, it should be noted that those skilled in the art commonly refer to devices for constructing curved structures as tracks, plates and runners interchangeably.

Thus, further improvements in the field of runners for constructing curved walls are necessary. In particular, it would be desirable to provide a runner which is readily compatible with conventional framing practices. Such a runner should provide adequate strength, minimal labor requirements, cost efficiency and flexibility in application. In particular, there is a need for an improved runner which may be readily formed and retained in a desired radius. Further, there is a need for an apparatus which is compatible with conventional framing operations such as nailing, toe-nailing and other conventional construction techniques.

SUMMARY OF THE INVENTION

The present invention provides improved apparatus and methods of forming a curved structure which meet the needs described above.

In one embodiment, the current invention provides a runner for forming curved structures. The runner comprises at least two sections capable of being arranged on a radius. Each section has at least two staggered layers. More preferably, each section has at least three layers with at least one layer being staggered. Each layer has a first end with a concave portion. Preferably the concave portion is located between two tabs. Additionally, each layer has a second end with at least a portion of the second end having a convex configuration. Preferably, the convex portion carries a centrally located protrusion.

In another embodiment, the current invention provides a runner for forming curved structures. The runner comprises at least two sections with each section having at least three layers. Preferably each layer used to form the section is substantially identical. Each layer has an upper surface, a lower surface, opposing side walls, a first end and a second end. The first end has a concave portion located between two tabs with the transition from the tabs to the sidewalls being defined by tangential sidewalls. Thus, the tangential sidewalls join the tabs to the sidewalls. At least a portion of the second end is a convex portion. The convex portion is defined by a radial arc which is preferably less than 180 degrees. The convex portion is joined to the sidewalls by tangential walls. When assembled as a section, at least one layer is offset and reversed from the next upper or lower layer. Thus, the second end of the offset layer extends beyond the first end of at least one other layer.

In still another embodiment, the current invention provides a runner for forming curved structures. The runner comprises at least two sections with each section having at least two layers. Each layer has a first end with a concave portion located between two tabs. Additionally, each layer has a second end which includes a central convex portion, at least two arcuate tabs and at least two arcuate recesses.

In yet another embodiment, the current invention provides a runner for forming curved structures. The runner comprises at least two sections, each section having at least two substantially identical layers. Preferably, each section has at least three identical layers. Each layer has an upper surface, a lower surface, opposing side walls, a first end and a second end. The first end includes a centralizer portion located between two recesses. Positioned adjacent to each recess is at least one tab wherein the tabs are joined to the sidewalls by tangential walls. The second end includes a central convex portion, at least two arcuate tabs and at least two arcuate recesses. The distance between the arcuate tabs is less than the maximum width of the layer and the arcuate tabs are joined to the sidewall by tangential walls. When assembled as a section, at least one layer is offset and reversed from another layer such that the second end of the offset layer extends beyond the first end of at least one other layer.

In yet another embodiment of the current invention, a runner is provided comprised of two or more sections. Each section is an integral component which carries at least two outwardly projecting extensions with each extension have at least a partial convex configuration. Additionally, each section carries at least two recesses having a concave area. More preferably, each section carries at least three outwardly projecting extensions and has at least three recesses with concave areas. When the sections are assembled as a runner, the convex portion of one extension is received within a corresponding concave area of the adjacent section's recess.

Additionally, the current invention provides an embodiment which is particularly suited for forming archways. The runner suitable for forming archways comprises at least two sections. Each section carries a plurality of extensions or flanges with at least two extensions projecting from one side of the section and at least one extension projecting from the opposite side of the section. The extensions define gaps which correspond in configuration to the dimensions of the extensions. A runner is prepared by positioning the extension(s) of one section within the gap(s) of an adjacent section. Preferably, each extension includes a passageway suitable for receiving a pin or dowel. The pin or dowel secures adjacent sections to one another and defines a pivot point between adjacent sections. The resulting pivot point is preferably below the midpoint of the section. Thus, the resulting runner will form an arc in only a single direction.

Still further, the current invention provides a method for preparing a structural base for a curved surface. The method of the current invention comprises providing two or more sections capable of being arranged and secured on a radius. The sections comprise at least two layers with at least one layer offset or staggered from another layer. If more than two layers are used in the section at least two layers are positioned directly above one another. Preferably each layer is substantially identical. A runner for forming the curved structure is prepared by positioning one section adjacent to another section by inserting the second end of one layer into the first end of an adjacent layer. Following assembly, the sections are placed on the desired radius and secured.

DETAILED DESCRIPTION OF THE PREFERRED EMBODIMENT

The preferred embodiments of the present invention will be discussed with reference to the attached drawings. When discussing the various embodiments of the current invention, like reference numbers refer to like parts throughout the drawings and this description.

Figure 1:
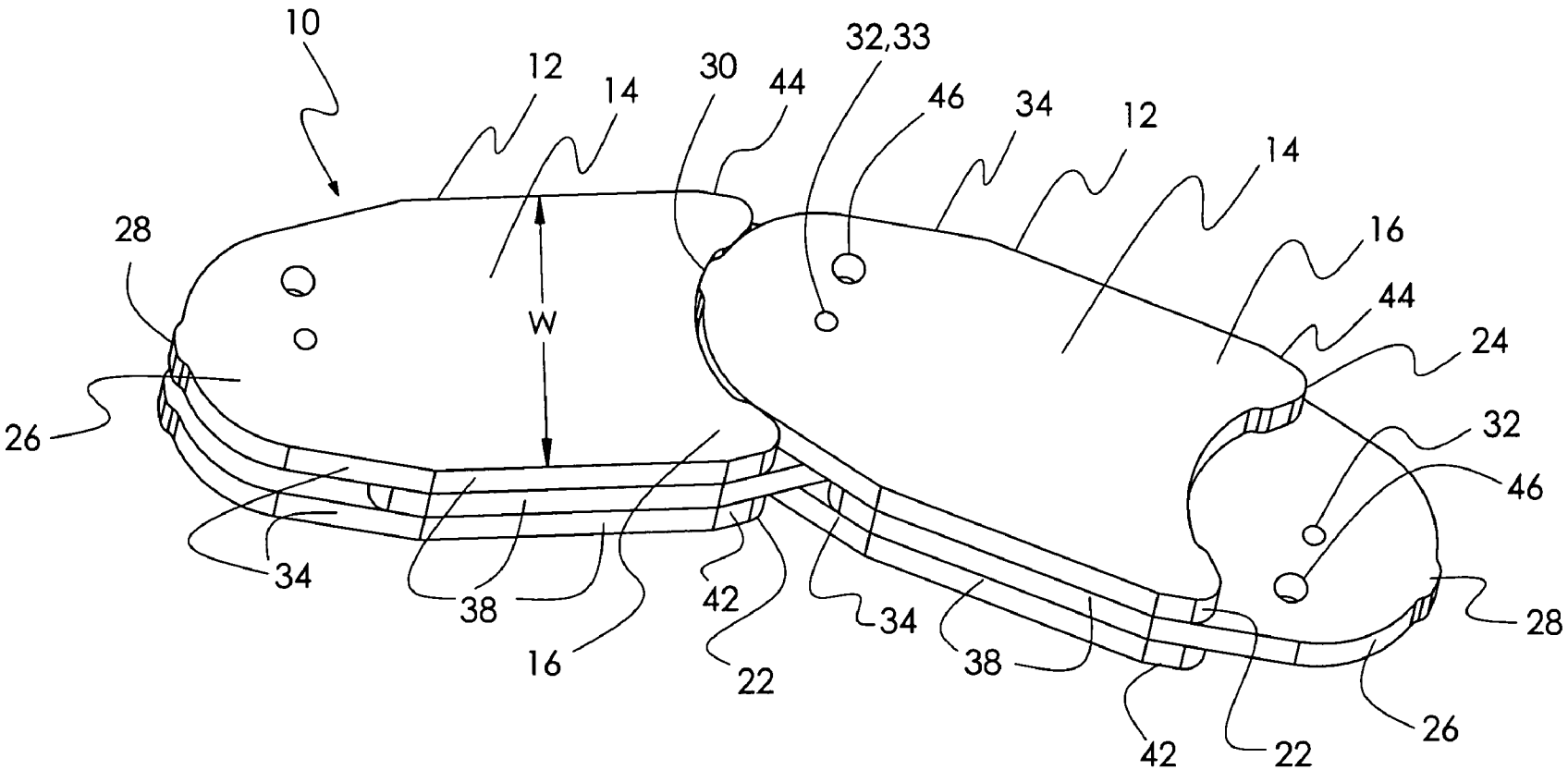
FIG. 1 depicts the preferred embodiment of the current invention arranged on a radius.

FIGS. 1-4 depict one preferred embodiment of the current invention suitable for constructing curved walls and archways. As shown in FIG. 1, the device of current invention provides a foundation or runner 10 for constructing a curved surface. This embodiment comprises sectional components having at least two and preferably three layers 14. When three or more layers are used for section 12, every other layer 14 is staggered or offset and reversed from every other layer 14. In the preferred three layer embodiment, middle layer 14*b* is offset and reversed such that it is sandwiched between the upper and lower layers 14*a*, 14*c* which are positioned one above the other.

The three layered embodiment is particularly preferred in applications which will experience axial loading. Under conditions of axial loading, the use of three layers 14 will prevent flexing of joints 30. Excessive flexing of joints 30 will likely result in separation of adjacent sections 12. Typically, separation may occur as flexing will result in loss of pivot pins 33 from holes 32. Additionally, such flexing may release nails or other similar devices 35 used to fix adjacent sections 12 on a desired radius. However, the preferred three layer embodiment resists flexing due to the overlap of layers 14 between adjacent sections 12.

Sections 12 are assembled to provide runner 10 for constructing a curved surface. Except for the terminating sections 12 of runner 10, each end 26 of one layer 14 is positioned within end 16 of an adjacent layer 14.

Figure 3:
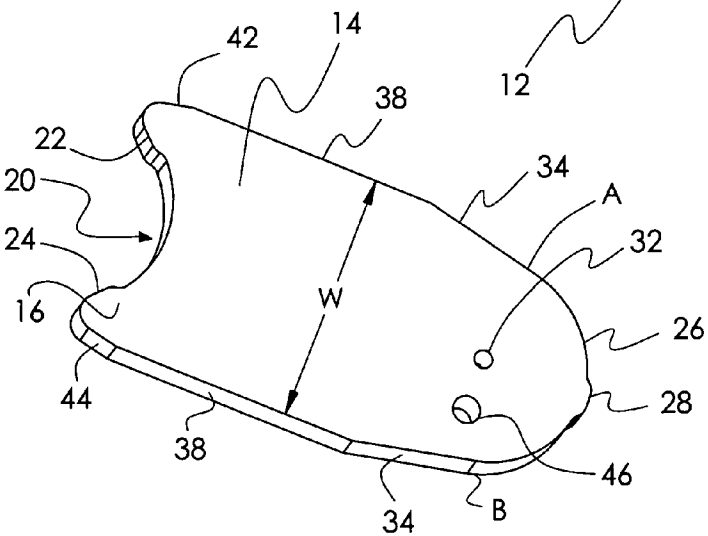
FIG. 3 depicts a perspective view of a single layer used in forming a section of the device provided by the current invention.

FIG. 3 depicts a perspective view of single layer 14 used to form section 12 of runner 10. As seen in FIG. 3, layer 14 includes a first end 16 having a generally concave configuration. Preferably, a concave recess 20 is positioned between range defining tabs 22 and 24. Additionally, layer 14 has a second end 26 defined by a generally convex curve. Preferably second end 26 carries at least one protrusion 28. In the preferred embodiment, protrusion 28 is preferably centrally located and extends outwardly from convex end 26. The length of protrusion 28 preferably corresponds to the length of tabs 22 and 24 and/or depth of concave recess 20. Positioning of end 26 within end 16 forms a joint 30 defined by the contact of tabs 22, 24 with end 26 and the contact of protrusion 28 with end 16.

In the preferred embodiments depicted by several of the Figures, including 1, 4, 6, 13 and 21, the resulting joint 30 is sufficiently tight so as to substantially preclude the passage of water and air. Preferably, joint 30 is water tight. Further, protrusion 28 and tabs 22, 24 cooperate to define the radius of movement of adjacent sections 12. Cooperation of tabs 22, 24 with protrusion 28 also prevents shearing of the pivot pin 33 located within hole 32 due to over rotation of sections 12. Thus, tabs 22, 24 carry the resulting load from positioning and securing runner 10 thereby precluding application of lateral and twisting forces to pin 33.

Additionally, tabs 22, 24 and protrusion 28 provide low friction points by minimizing surface area contact between sections 12 thereby reducing the load on the pivot pin during positioning of sections 12. Further, when positioned on a tight radius such that protrusion 28 is in contact with either tab 22 or tab 24 the other tab 22, 24 will contact one tangential wall 34. Thus, tangential wall 34 also acts as a stop to further preclude tension on pivot pin 33. As used herein, tangential wall 34 is an angled wall joining or defining end 26 to sidewall 38 such that end 26 has an overall width less than the width—W—of layer 14. Therefore, for the purposes of this disclosure, tangential walls 34 and 42, 44 are not defined by a line which is necessarily perpendicular to the radius of the arc. Rather, tangential walls 34, 42 and 44 define a reduced area suitable to provide the clearance necessary to preclude undesired corners when runner 10 is placed on a radius.

Figure 4:
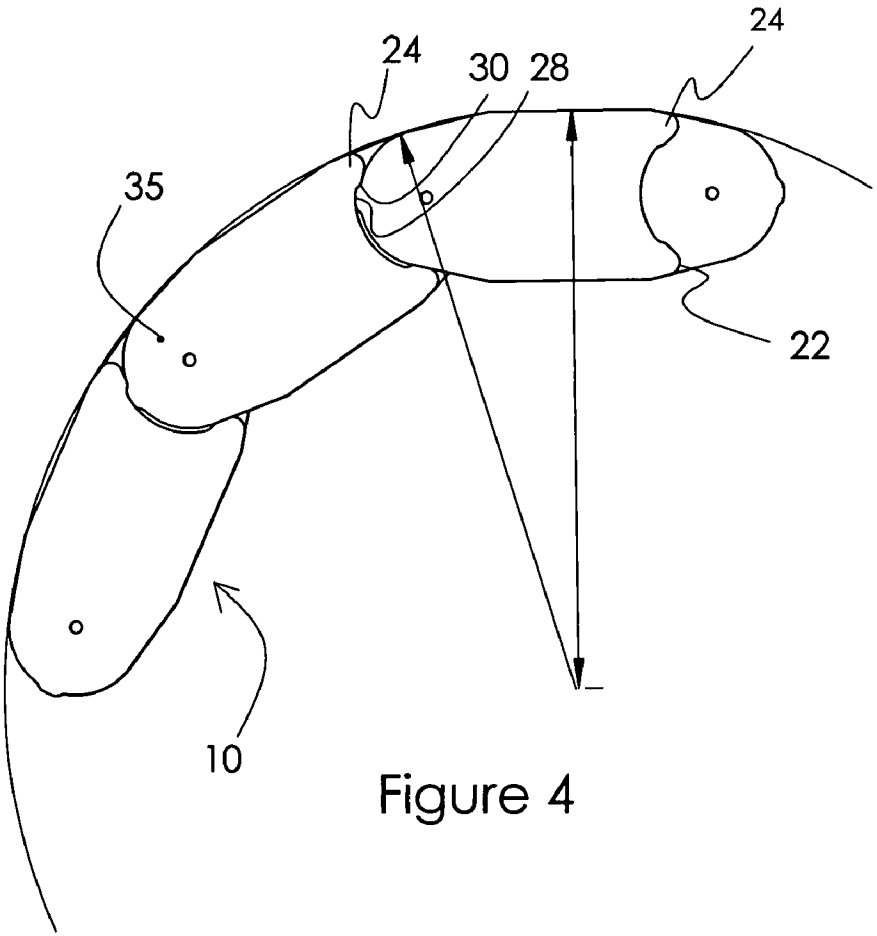
FIG. 4 demonstrates the uniform radius provided by the current invention.

Further, symmetries of the preferred embodiment are demonstrated by FIG. 4 wherein the radial arcs of tabs 22, 24 and protrusion 28 are preferably matched or concentric such that when protrusion 28 contacts tab 22 or 24 a nesting relationship is established. This matched or abutting relationship between protrusion 28 and tabs 22, 24 further enhances the seal provided by joint 30.

With reference to FIG. 4, the preferred embodiment of the current invention provides a runner 10 which does not require trimming after positioning of sections 12 in the desired configuration. As depicted in FIG. 4, the current invention permits positioning of studs anywhere along the length of runner 10. As discussed below, the symmetrical design of layer 14 provides a consistent radial arc when runner 10 is positioned on the desired radius. Thus, runner 10 does not require trimming to eliminate undesired corners following positioning.

The current invention preferably utilizes identical layers 14 to prepare section 12. Layer 14 has multiple symmetries which simplify production of runner 10 while eliminating several steps during construction of curved surfaces. As shown best in FIG. 3, the width of end 26 is less than the overall width of layer 14. Further, the radial arc defined by end 26 is preferably less than 180° when measured from point A to point B. Preferably, the radial arc is defined by the type of curved construction and the studs or equivalent to be used during construction. In general, the preferred width—W—of layer 14 will correspond to the width of the studs used to form the wall or archway. To preclude undesired corners when positioned on a radius, tangential walls 34 join end 26 to side walls 38. Similarly, the radius of each tab 22, 24 is foreshortened and joined to side walls 38 by tangential walls 42, 44 respectively. As shown in FIG. 1, tangential walls 34, 42 and 44 align when layers 14*a*, 14*b* and 14*c* are arranged in the preferred embodiment. Thus, as depicted in FIG. 4, when positioned on a radius no portion of sections 12 extends beyond the radius of the desired curved structure.

In a preferred embodiment, at least one hole 32 passing through layer 14 is provided a distance from end 26 and centrally located between the sides of layer 14. Further, in the preferred embodiment offset layer 14*b* is offset a distance such that hole 32 in the offset layer 14*b* aligns with hole 32 in layers 14*a* and 14*c* when two or more sections 12 are joined together to form runner 10. Thus, the aligned holes 32 define a pivot point between adjacent sections 12. In the preferred embodiment, a pin or dowel 33 is positioned within this pivot point, i.e. hole 32, thereby securing adjacent sections 12 to one another in a pivotal relationship. This embodiment allows for fine adjustment of runner 10 prior to securing adjacent sections 12 to one another in a nonpivotal relationship.

Figure 2:
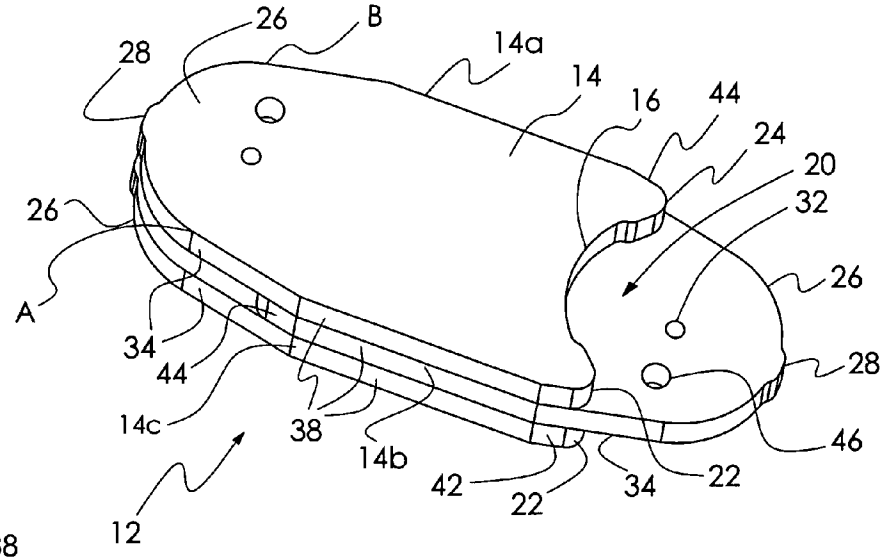
FIG. 2 is a perspective view of the preferred embodiment of the current invention.

As depicted by FIG. 2, the current invention may include a glue hole 46 passing through layer 14. Glue hole 46 provides one mechanism for securing runner 10 in the desired position. As shown in FIG. 1, glue hole 46 is occluded by end 26 of layer 14*b* of an adjacent section 12. When constructing a curved wall or archway, the desired radius is typically traced on the supporting surface. Before positioning runner 10 along the desired radius, a sufficient quantity of glue or similar compound is placed in glue hole 46 and adjacent sections manipulated to ensure distribution of glue between adjacent sections 12. Prior to setting of the glue, runner 10 is positioned as desired and the glue is allowed to set. Alternatively, nail 35, tack or other similar device may be used alone or in combination with glue to secure runner 10 in position.

Use of nail 35 or similar device to secure adjacent sections creates a shear pin effect by penetrating at least two layers 14 of section 12. Preferably, nail 35 penetrates into at least a third layer 14. In the preferred embodiment, layer 14 is a solid material throughout the structure of layer 14. Use of a solid structure increases the surface area in contact with nail 35 thereby reducing the likelihood of nail 35 being twisted or flexed out of section 12 by application of axial and/or lateral forces on section 12. Finally, to enhance the securing strength of nail 35, nail 35 is preferably located a substantial distance from pin 33.

Figure 6:
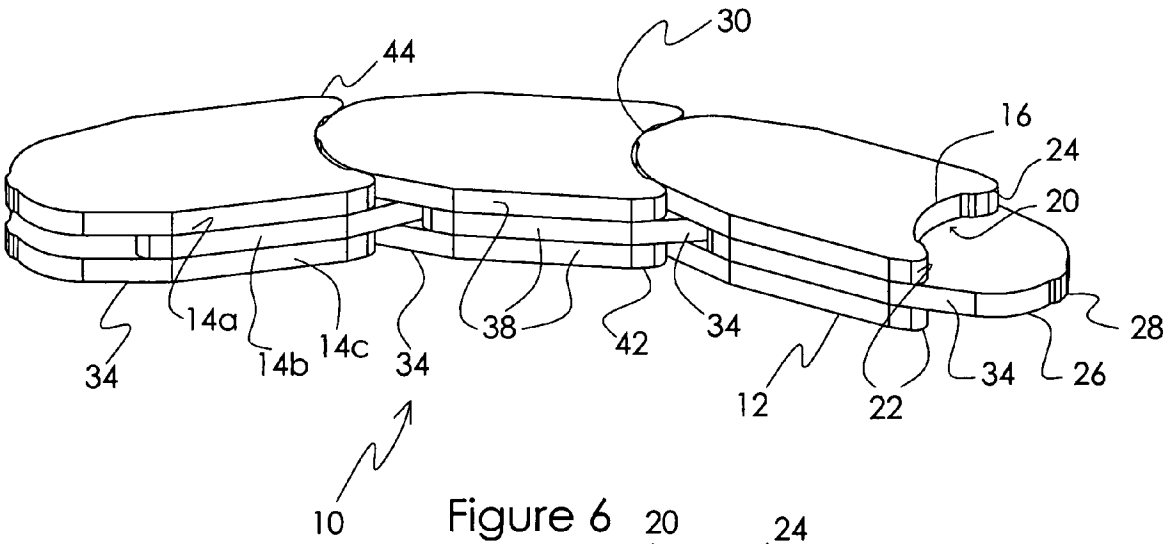
FIGS. 6-8 depict alternative embodiments of the current invention.

While the embodiment of FIGS. 1-3 depicts hole 32, one skilled in the art will recognize that hole 32 may be readily omitted without impairment to the use of runner 10 or the degradation of the integrity of joint 30. As noted above, joint 30 limits the passage of air and water due to the contact points defined by tabs 22, 24 and protrusion 28. The tightness of the resulting joint is due in part to tabs 22, 24 of layers 14*a* and 14*c* and protrusion 28 of layer 14*b* being concentric with one another in that they share the same center point as measured from hole 32. Additionally, concave recess 20 and convex end 26 are concentric as measured from hole 32. Since each layer 14 is preferably identical, the fit of layer 14*b* between layers 14*a* and 14*c* of adjacent sections 12 is relatively tight. As such, runner 10 may be formed on location by adding a desired number of sections 12 to form a curved runner 10 of the desired length. The interaction of protrusion 28 with tabs 22 and 24 provides a self-centering feature which reduces reliance upon a pivot point such as defined by hole 32. Thus, as depicted in FIG. 6, sections 12 may be formed and joined together to form runner 10 without hole 32 or optional glue hole 46.

Figure 22:
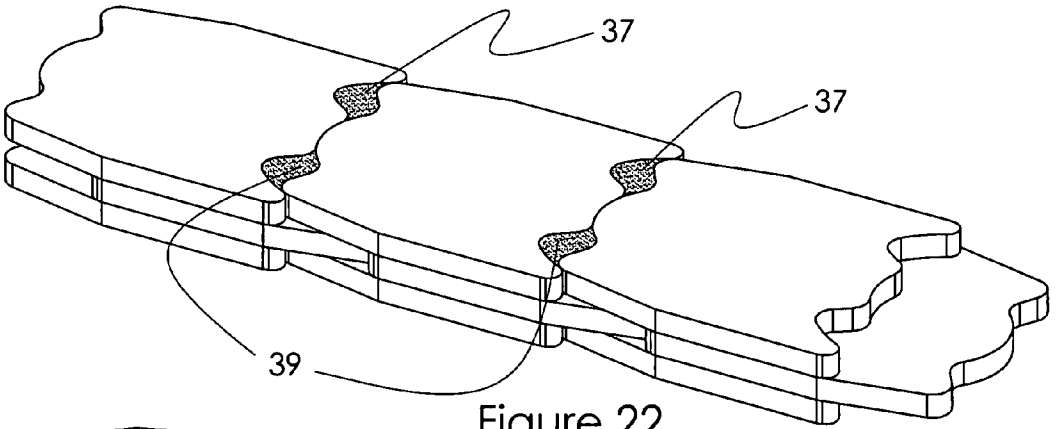
FIGS. 22-23 depict alternative embodiments of the current invention utilizing an elastic material to secure sections to one another.
Figure 23:
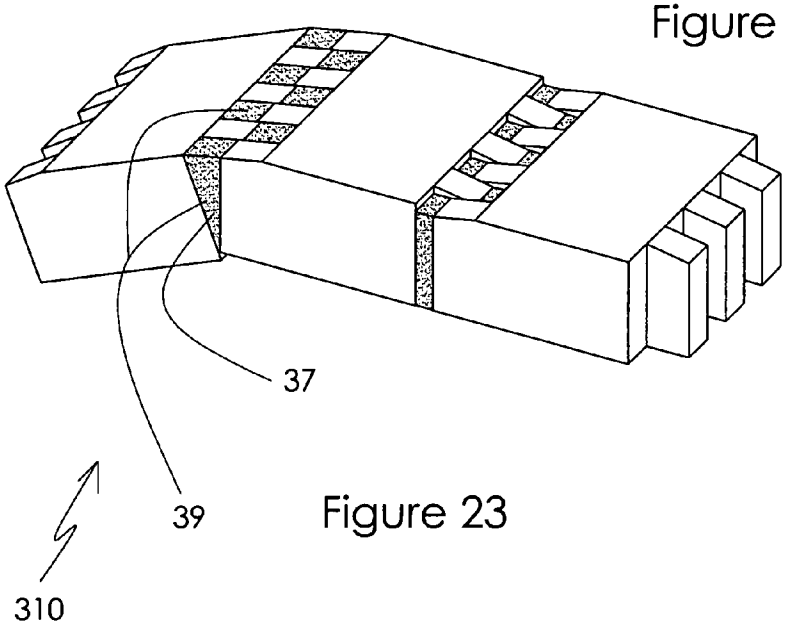

In one preferred embodiment of runner 10 depicted in FIGS. 22 and 23, sections 12 and 312 are secured to one another by an elastomeric compound 37 including but not limited to elastic caulking materials, polyurethane foams, and natural rubber foams such as foam rubber. In this embodiment, elastomeric compound 37 is injected into gaps 39 between adjacent sections 12 during assembly of runner 10. Elastomeric compound 37 has sufficient elasticity to permit pivoting of adjacent sections 12 in relation to one another. Additionally, elastomeric compound 37 is sufficiently compressible such that the pivoting range of adjacent sections is not adversely impacted. One skilled in the art will recognize that elastomeric compound 37 may also be used in the other embodiments disclosed herein. When elastomeric compound 37 is used in the embodiment of FIG. 1, hole 32 and pin 33 are optional.

Figure 8:
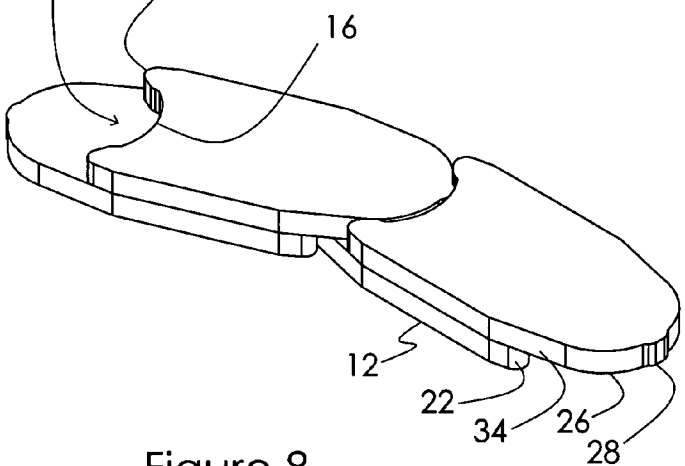
Figure 7:
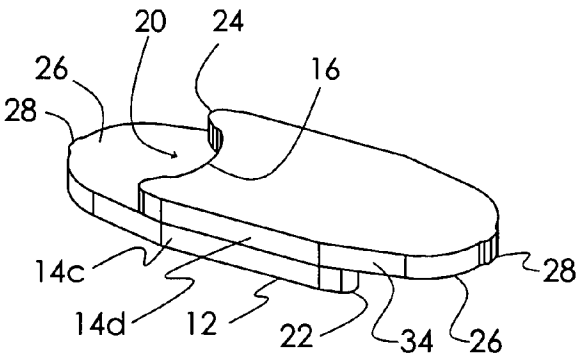
Figure 9:
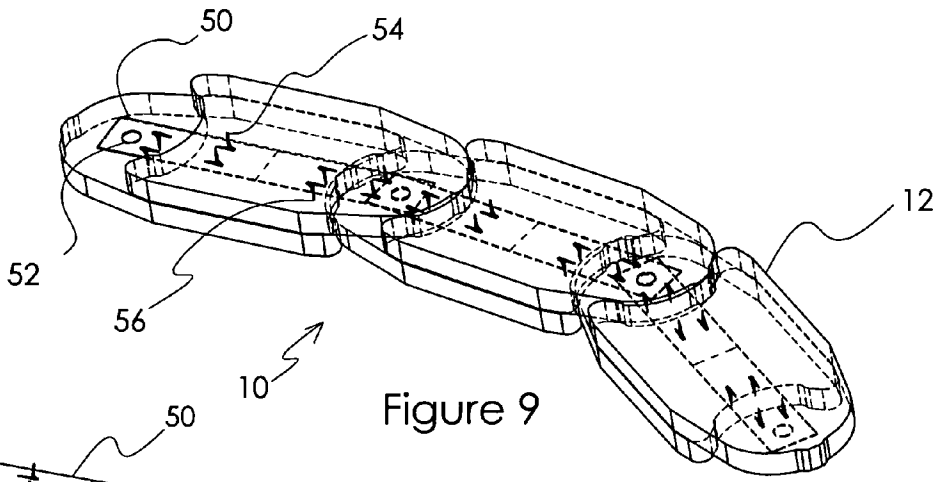
FIG. 9 depicts an alternative embodiment of the current invention including a reinforcing metal strip.

While one preferred embodiment of the current invention 10 utilizes sections 12 comprising at least three layers 14, embodiments comprising greater or fewer layers are also contemplated by the current invention. For example, if the axial strength of runner 10 is not critical, then a two layer embodiment as depicted in FIGS. 7-8 may be suitable. As shown in FIG. 8 two layers 14*d* and 14*e* are staggered and reversed in direction. Thus, end 26 of one layer 14*d* extends beyond end 16 of second layer 14*e*. When assembled, at least one end 26 of one section 12 overlaps end 26 of an adjacent section 12. Although shown in FIGS. 8 and 9 without pivot hole 32 and glue hole 46, the preferred embodiment may include these optional features in the same manner as described above.

As noted above, layers 14 in each embodiment will preferably have substantially identical designs. However, the thickness of each layer 14 may vary. Thus, as used herein a substantially identical layer 14 may differ in thickness from other layers 14 within the same section 12 and other sections 12 of runner 10. Preferably, each layer 14 has an identical geometric configuration aside from thickness.

Figure 10:
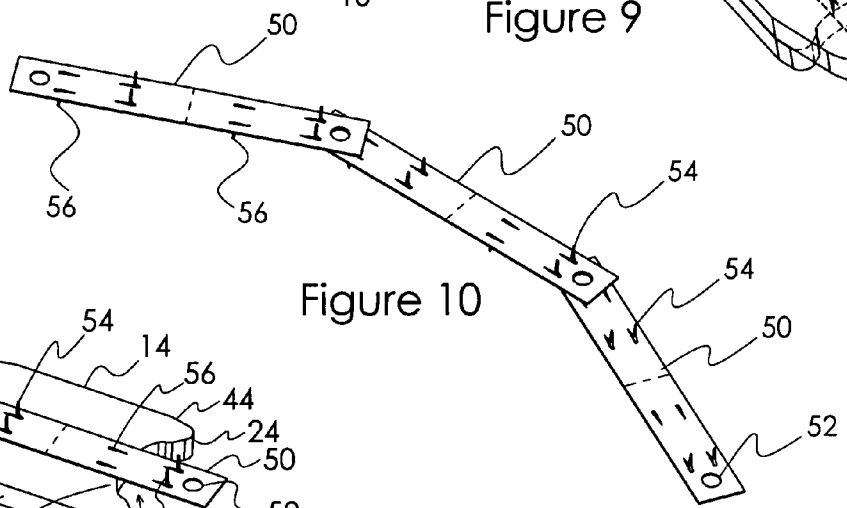
FIG. 10 depicts a reinforcement strip suitable for use in the current invention.
Figure 11:
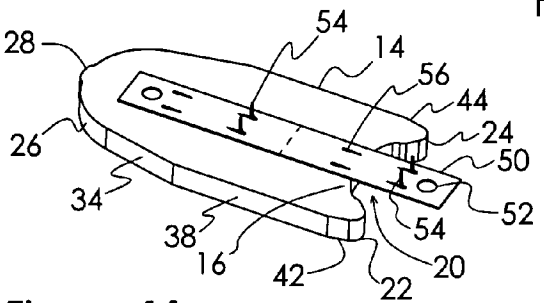
FIG. 11 depicts an alternative embodiment of the current invention including a reinforcing strip.

In the embodiments of FIGS. 1-4 and 6-8, individual sections 12 are prepared by nailing, tacking or gluing layers 14 to one another in the arrangement depicted. However, with reference to FIGS. 9-11, an alternative embodiment provides a reinforcing metal strip 50 positioned between each layer 14.

Metal strip 50 provides additional structural rigidity to section 12. However, use of metal strip 50 reduces the effectiveness of glues. In the preferred embodiment, metal strip 50 carries at least one upwardly projecting gang nail 54 and at least one downwardly projecting gang nail 56. Preferably gang nails 54 and 56 are located in an area of metal strip 50 which corresponds to the overlapping portions of layers 14 in section 12 when used in a two layer embodiment. A similar arrangement would be preferred in a three layer embodiment.

Preferably when using metal strip 50, pivot hole 32 is omitted from layer 14. In this embodiment, metal strip 50 carries a pivot hole or pivot point 52 which permits pivotal movement of adjacent sections 12. While metal strip 50 may have a width corresponding to the width of layer 14, more preferably, metal strip 50 will be centered on layer 14 and have a width between about 20% to about 50% of the width of layer 14. Finally, if glue hole 46 is provided along with metal strip 50, glue hole 46 is preferably positioned in area outside of the area covered by metal strip 50. Further, a second glue hole (not shown) is preferred to ensure adequate locking of adjacent sections 12.

Metal strip 50 comprises a series of strips 51 which may be joined in a pivotal relationship. As depicted in the Figures, pivot point 52 is formed by combining an eyelet (not shown) and an eyelet receiving hole (not shown). Techniques for forming eyelets and eyelet receiving holes are well known to those skilled in the art. As known to those skilled in the art, properly securing eyelet 56 within eyelet receiving hole permits pivotal movement of adjacent strips 51 in relation to one another. Pivot points 52 of this type are advantageous due to the ease and cost efficiency of manufacturing.

In the preferred embodiment discussed above, layers 14 of the present invention are prepared from wood, plywood, oriented strand board, particle board plastic, (including expanded or foamed versions such as foam pvc) or wood/plastic composites or other composite materials suitable for receiving nail 35. As used herein, a material suitable for receiving a nail will be any composition which will permit a nail to be installed within its body while providing resistance against a substantial portion of the sides of the nail such that the nail is retained and resists the tendency to be extracted or rejected from the material. A finely woven network or honeycomb of synthetic material would likely be suitable to receive a nail. However, thin walled or hollow materials do not provide sufficient retention on the nail as an insufficient portion of the nail's surface contacts the material.

The currently preferred material for layer 14 includes solid wood or oriented strand board. Use of these materials allows for construction of curved walls or other curved surfaces using conventional framing techniques. Thus, following positioning and securing of runner 10 in the desired radius, studs may be positioned and nailed to runner 10 without using special techniques.

Figure 16:
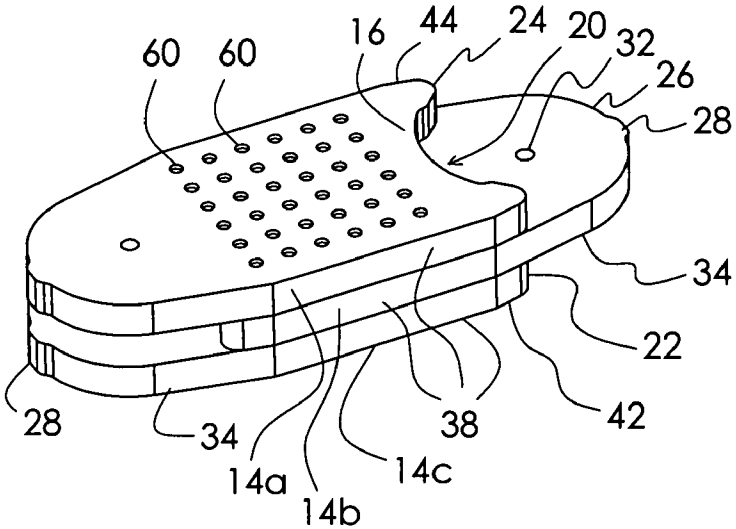
FIG. 16 depicts a layer having a plurality of dimples in the top surface.

In the preferred embodiments discussed above and below, layer 14 may optionally include surface treatments designed to further improve construction techniques of curved walls and archways. For example as depicted in FIG. 16, upper layer 14*a* carries a plurality of recesses or dimples 60. Dimples 60 on surface 14*a* reduce the likelihood of nail deflection when securing a stud (not shown) to runner 10. To simplify the manufacturing process of layers 14, each layer 14 will preferably carry dimples 60; however, one skilled in the art will recognize the primary benefit of this embodiment is provided by surface layer 14*a*; therefore, dimples 60 are not required on layers 14*b* and 14*c* or other successive layers 14.

Figure 12:
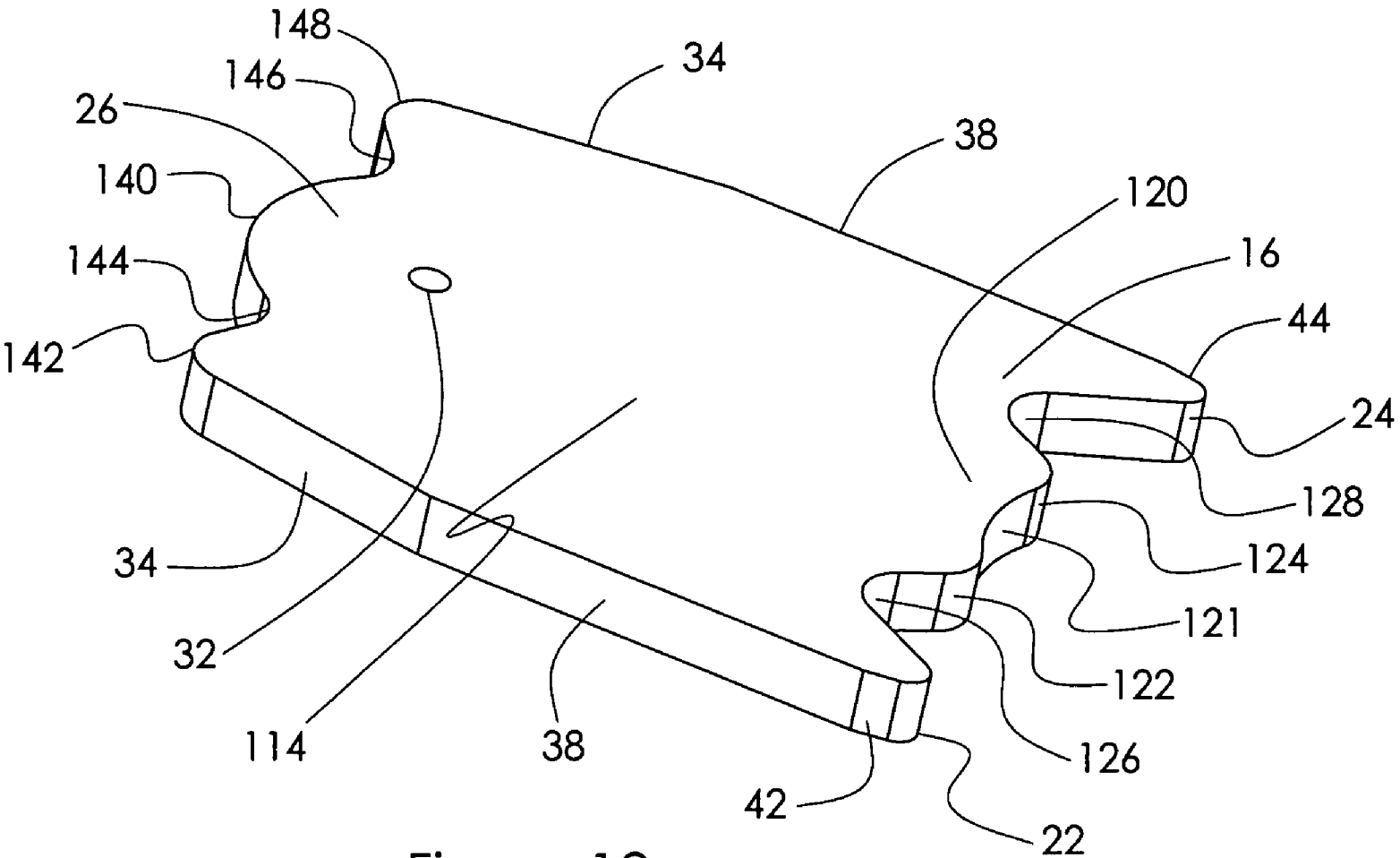
FIG. 12 is a perspective view of an alternative layer used in the current invention.
Figure 13:
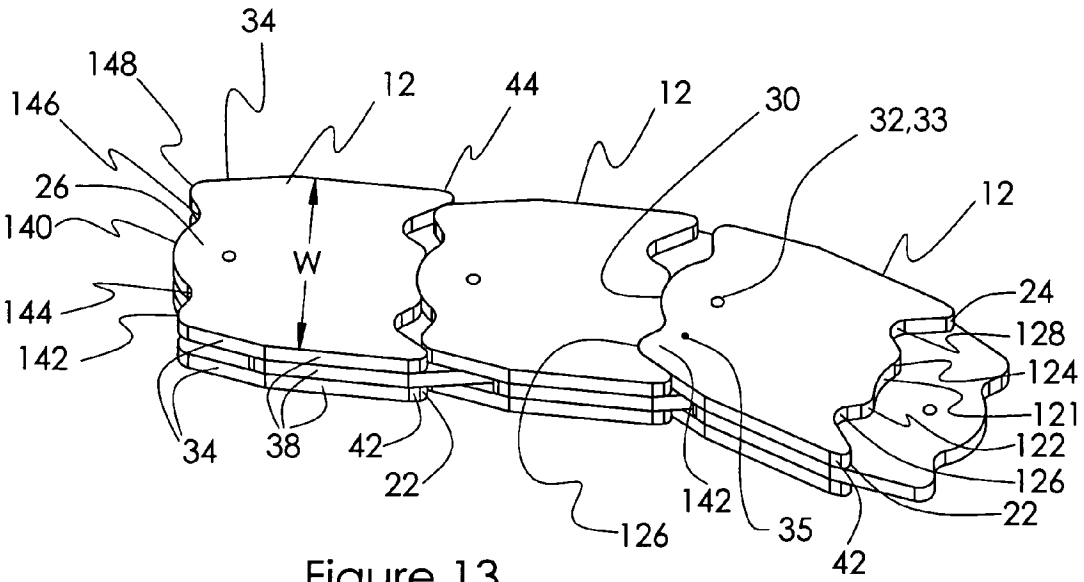
FIG. 13 depicts a preferred embodiment of the current invention using the layer of FIG. 12.

With reference to FIGS. 12-13, an alternative design of layer 14 is provided. In FIGS. 12-13, the alternative design of layer 14 is identified as layer 114. As in the embodiment discussed above, each layer 114 preferably is identical. However, layers 114 may vary in thickness. Thus, as used herein a substantially identical layer 114 may differ in thickness from other layers 114 within the same section 12 and other sections 12 of runner 10. Preferably, each layer 114 has an identical geometric configuration aside from thickness.

Layer 114 differs primarily from layer 14 by providing a lower length to width ratio. Thus, manufacture of layer 114 generates less waste. Further, to accommodate a lower length to width ratio, concave recess 20 of layer 14 has been replaced with a centralizer portion 120 which includes a concave portion or recess 121 positioned between smaller arcuate tabs 122 and 124. Centralizer portion 120 provides a self centralizing feature during assembly of adjacent sections 12. Centralizer portion 120 fills much of the area previously vacated by concave recess 20. As a result, the self centralizing aspect of layer 114 also increases the surface area of end 16. The increased surface area strengthens joint 30 and improves the effectiveness of glue or other device such as nail 35 used to secure runner 10 in position. Finally, as in the prior embodiment, layer 114 carries range defining tabs 22 and 24 on first end 16.

Second end 26 of layer 114 has also been modified to correspond to and be readily received within end 16 of an adjacent layer 114. As shown in FIG. 12, end 26 of layer 114 includes a central convex or arcuate portion 140 having an outer radius corresponding to the inner radius of recess 121. In this embodiment, end 26 has been shortened when compared to the embodiment of FIGS. 1-4. Additionally, end 26 has two outer tabs 142, 148 and two arcuate recesses 144 and 146. Each recess being positioned between outer tabs 142, 148 and arcuate portion 140.

As shown in FIG. 13, centralizer portion 120 readily guides arcuate portion 140 into position during assembly of sections 12. When positioned on a radius as depicted in FIG. 13, tab 142 is received into recess 126. When sections 12 are positioned on a tight radius, end 26 fits snugly or nests within a large portion of end 16 of an adjacent section. Thus, the resulting joint 30 is substantially water tight. Additionally, the distance from tab 142 to arcuate portion 140 enhances the stability and strength of runner 10. In particular, if nails 35 are the preferred mechanism for securing the radius of runner 10, the distance between 142 and 140 enhances the strength of the connection by moving nail 35 further from hole 32 which defines the pivot point between adjacent sections.

This embodiment is also designed to preclude undesired corners when positioned on a radius. As depicted in FIGS. 12-13, tangential walls 34 join end 26 to side walls 38. Similarly, the radius of each tab 22, 24 is foreshortened with the radius of each tab 22, 24 being joined to side walls 38 by tangential walls 42, 44 respectively. Thus, tangential walls 34, 42 and 44 align when layers 14*a*, 14*b* and 14*c* are arranged in the preferred embodiment. Thus, a radius generated using the embodiments of the current invention will not require trimming prior to finishing the curved structure. Additionally, as discussed above with regard to the embodiment depicted in FIGS. 1-4, when position on the tightest radius possible, one tab 22 or 24 will contact tangential wall 34. Thus, as depicted in FIG. 13, tangential wall 34 acts as a stop to preclude tension on pivot pin 33. With continued reference to FIG. 13, tab 142 or 148 will nest within arcuate recess 126 or 128 respectively. This arrangement enhances the seal of joint 30.

As discussed above with regard to the embodiment depicted in FIGS. 1-4 and 6-8, the pivot point provided by passageway 32 and pin 33 may be omitted. The self-centering aspect of the current invention provides for easy assembly even without the inter-relation of a pivot point. Optionally, as shown in FIG. 22, an elastomeric compound 37 such as foam rubber, may be used to secure adjacent sections 12 in a pivotal relationship. As discussed above, elastomeric compound 37 is positioned within gaps 39 following assembly of adjacent sections 112. Elastomeric compound 37 has sufficient elastomeric qualities to permit positioning of runner 10 on a radius.

Figure 14:
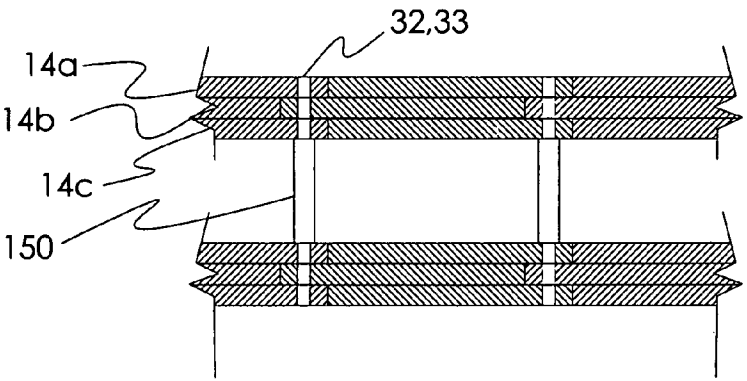
FIG. 14 depicts a side view of the embodiment of FIG. 1 including spacers positioned between layers.

As noted above, the current invention is useful for forming both curved walls and archways. Depending on the width of the archway, a three layer runner 10 may be insufficient. Although multiple layers beyond three layers may be used in the current invention, the alternative embodiment of FIG. 14 is one preferred embodiment for constructing archways. The embodiment depicted in FIG. 14 includes spacers 150 positioned between layers 14. Spacers 150 may be any conventional dowel rod, pipe or other device. Preferably, a hollow tube type structure is used as spacer 150 such that a single pin 33 may pass through hole 32 of layers 14, through spacer 150 and into the opposing set of layers 114. Thus, a dowel or pin 33 positioned within hole 32 permits pivotal movement between sections 12 as well as positioning and retention of spacer 150 in the preferred embodiment. However, it should be noted that spacer 150 is not restricted to positioning adjacent to hole 32. Rather, spacer 150 may be positioned at any convenient location along runner 10.

Figure 15:
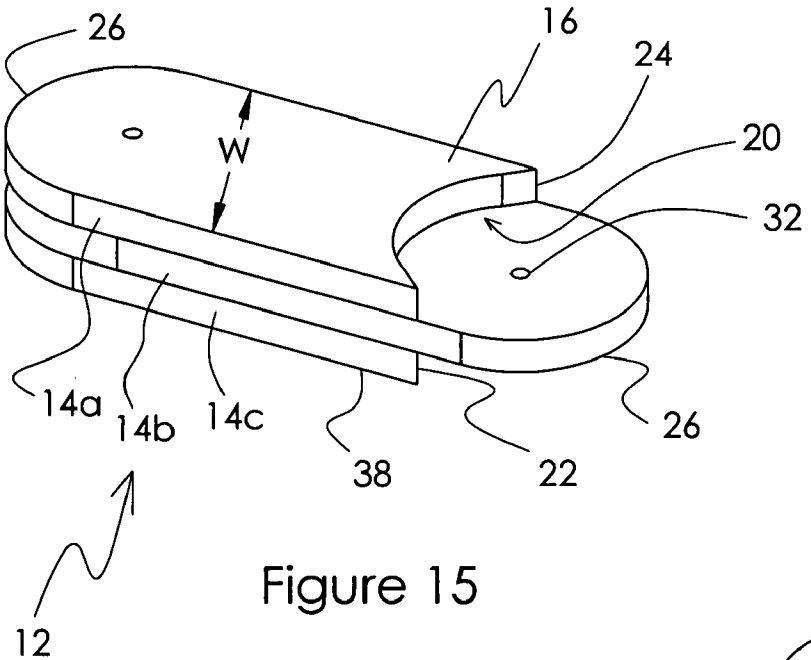
FIG. 15 is a perspective view of an alternative simplified embodiment of the current invention.

A simplified embodiment of the current invention is provided in FIG. 15. As depicted in FIG. 15, section 12 comprises at least two and preferably three layers 14*a, b* and *c*. In this embodiment, concave recess 20 of end 16 generally corresponds to the width of layer 14. Tabs 22 and 24 define the terminus of concave recess 20. Similarly, end 26 has a convex radius corresponding to concave recess 20.

Figure 5:
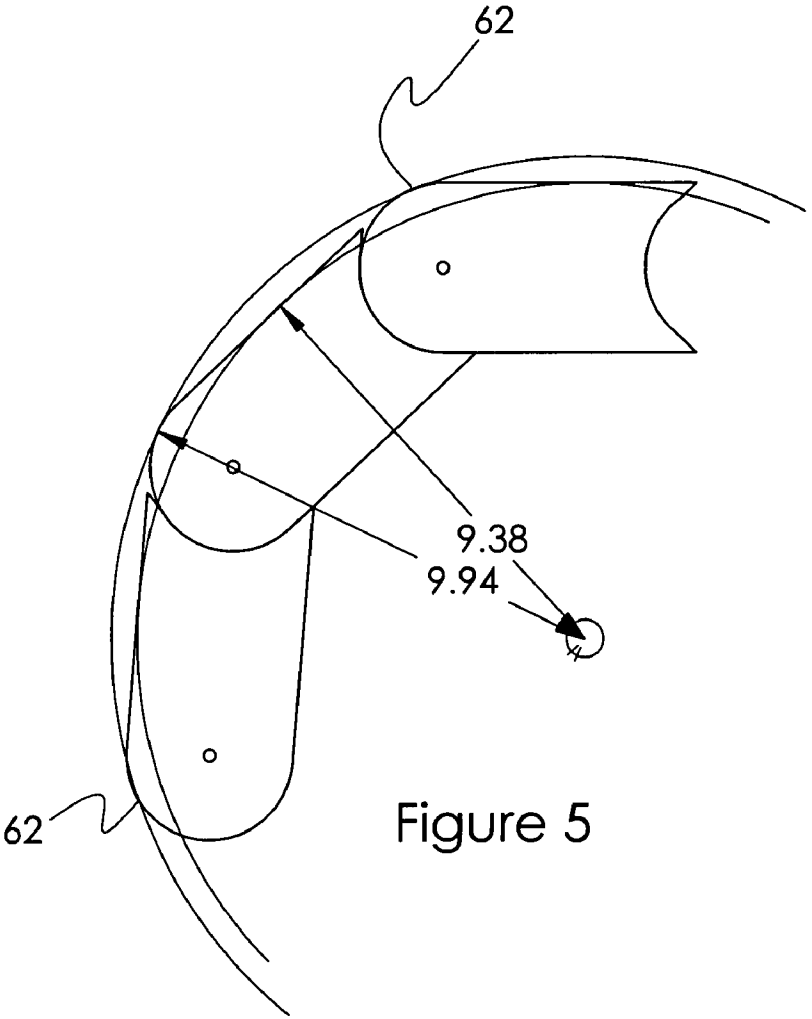
FIG. 5 demonstrates corners resulting from the use of a simplified version of the current invention.

The embodiment of FIG. 15 is generally quicker to manufacture as it requires fewer cuts to prepare a single layer. However, as depicted in FIG. 5, this embodiment generates two different radii of curvature when positioned on a radius. Thus, use of this embodiment restricts positioning of studs generally to the central portion of each section 12. Further, this embodiment will result in an uneven surface for securing drywall as the multiple radii generates corners 62.

Figure 24:
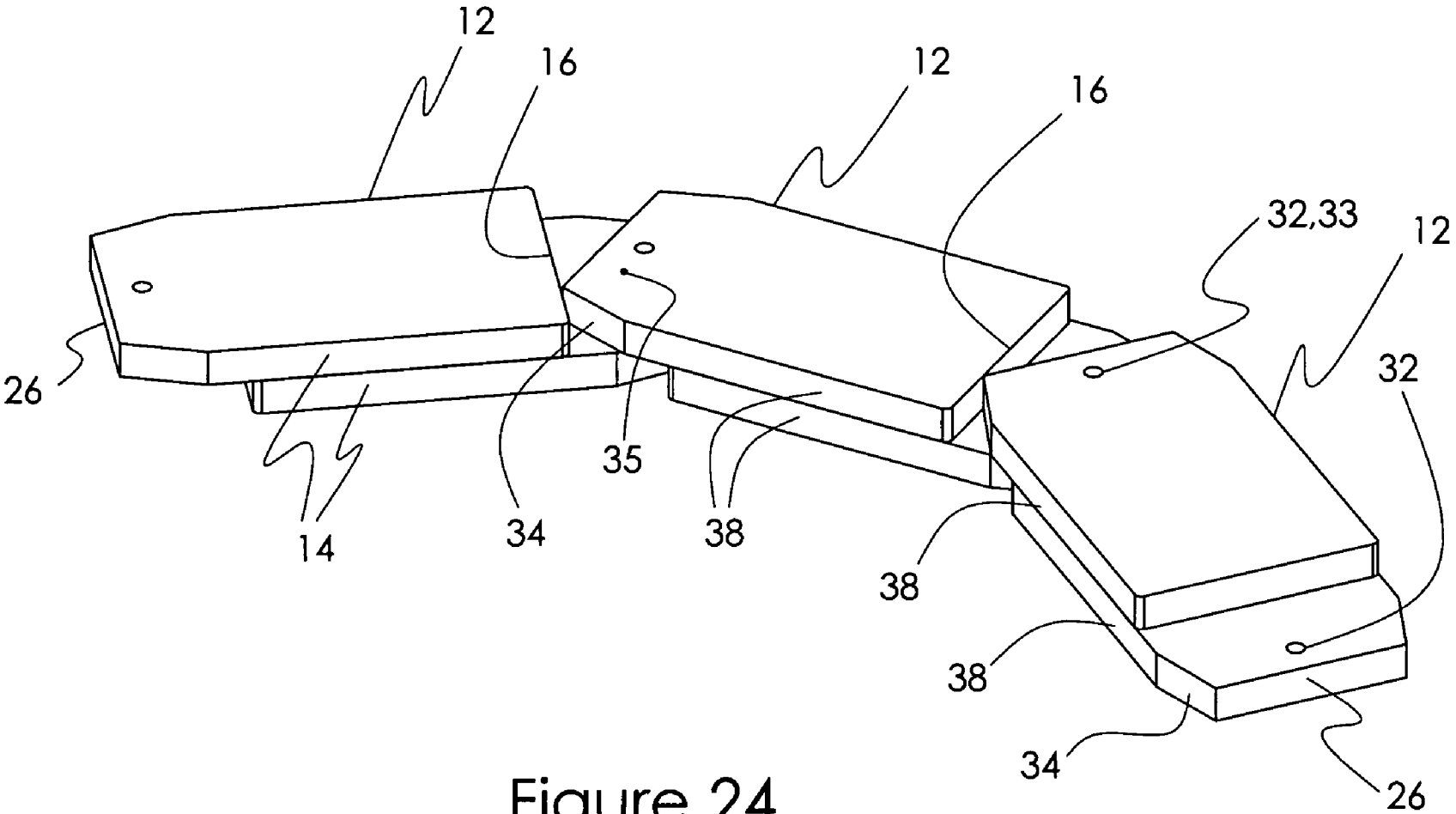
FIG. 24 is a perspective view of a simplified version of the current invention.

Another simplified embodiment of the current invention is depicted by FIG. 24. By eliminating the various convex and concave radii, the embodiment of FIG. 24 is generally easier to manufacture. Preferably, this embodiment minimizes or eliminates corners when placed on a radius by utilizing an end 26 which has a width less than the widest portion of layer 14. As shown in FIG. 24, end 26 is defined by angled or tangential sidewalls 42 which define and join end 26 to sidewalls 38. Thus, end 26 has a generally trapezoidal configuration while the primary portion of layer 14 is generally square or rectangular with optionally rounded corners.

Figure 21:
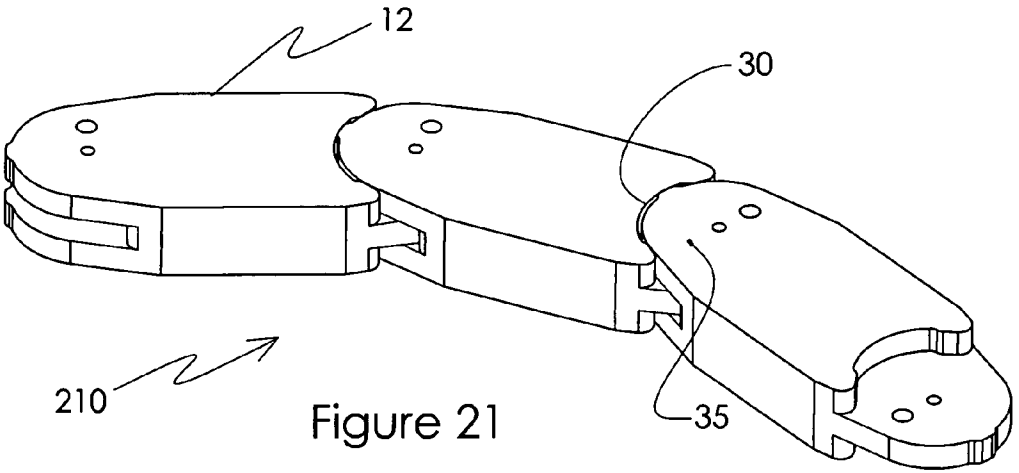
FIGS. 20-21 depict an embodiment of the current invention wherein each section is a single integral component.
Figure 20:
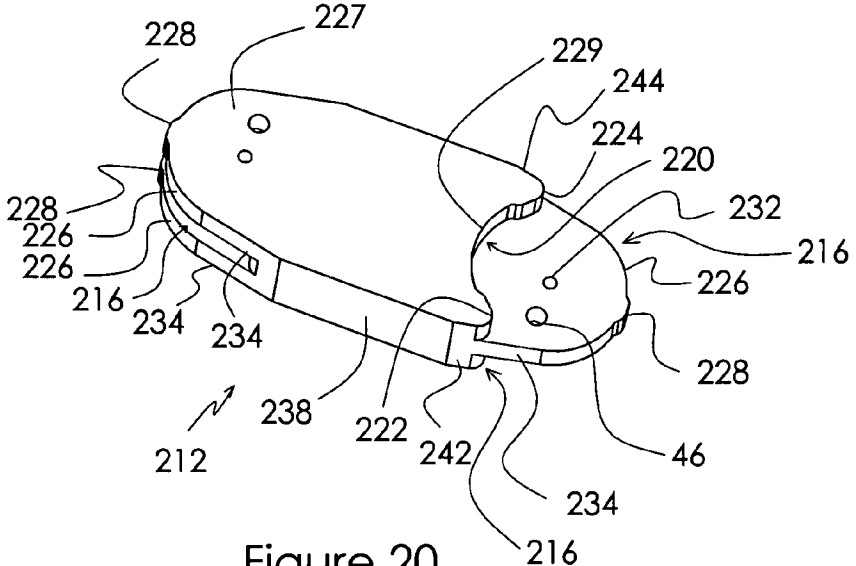

In the embodiments discussed above, sections 12 are preferably prepared by assembly of individual layers 14. However, as depicted in FIG. 20, section 212 may be integrally formed. Thus, runner 210 depicted by FIG. 21 consists of sections 212 wherein each section 212 generally corresponds to section 12 depicted in FIG. 2. However, section 212 does not comprise discrete individual layers 14 as discussed above. Rather, as shown in FIG. 20, the preferred embodiment of section 212 is an integrally formed component having at least three outwardly extending generally convex extensions 226. In the preferred embodiment, at least two extensions 226 are symmetrically disposed one above the other on a first side 227 and at least one extension 226 projects in a direction opposite of the symmetrically disposed ends 226 from a second side 229. Preferably, each extension 226 carries an outwardly extending protrusion 228. Each generally convex extension 226 is joined to sidewall 238 by tangential walls 234. Preferably, each extension 226 includes a passageway 232 which provides a pivot point 232 for joining adjacent sections 212.

Section 212 also includes at least three recesses 216. At least one recess 216 is located between two generally convex extensions 226 on first side 227. Second side 229 includes at least two recesses 216 on opposing sides of extension 226. Each recess 216 preferably terminates at tabs 222 and 224 which define stops and concave area 220. Concave area 220 is defined by a radius which is concentric with convex extension 226 when measured from passageway 232 and preferably has a depth corresponding to the length of protrusion 228. Tabs 222 and 224 are joined to sidewall 238 by tangential walls 242 and 244 respectively. As depicted in FIG. 20, extensions 226 carried by side 227 are preferably positioned opposite of recesses 216 carried by side 229. Preferably, section 212 is prepared from a solid block of wood, a composite material or a plastic material such as polyethylene, each suitable for receiving nail 35, tack or other similar device to secure runner 210 on the desired radius.

Although section 212 has been described with at least three generally convex extensions 226 and three recesses 216, one skilled in the art will recognize that section 212 will perform satisfactorily with only two convex extensions 226 and two recesses 216. Such an embodiment would generally correspond to the embodiment discussed above with reference to FIGS. 7 and 8. Additionally, one skilled in the art will recognize that sections 12 of the embodiment of FIGS. 12-13 may also be prepared as a single component in the manner discussed above.

Figure 17:
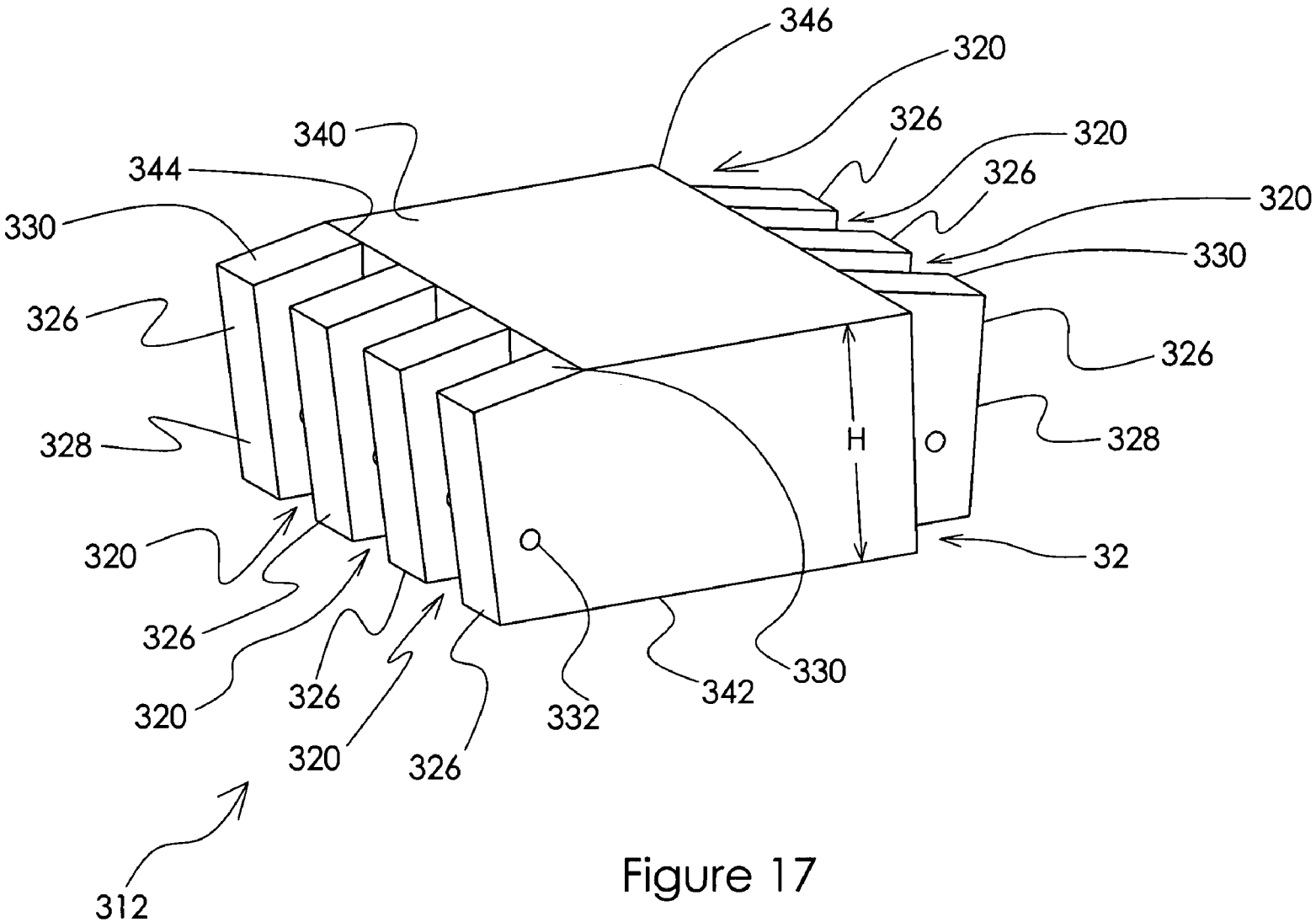
FIGS. 17-19 depict an embodiment of the current invention suitable for use in constructing archways.
Figure 18:
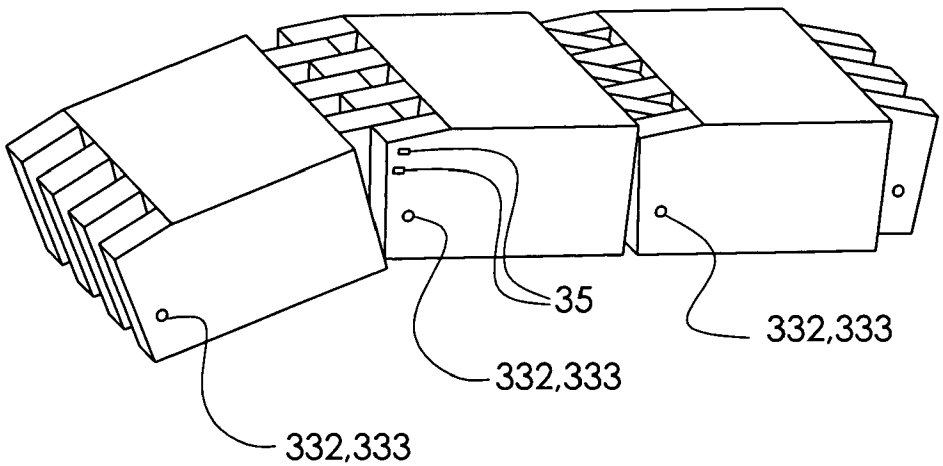
Figure 19:
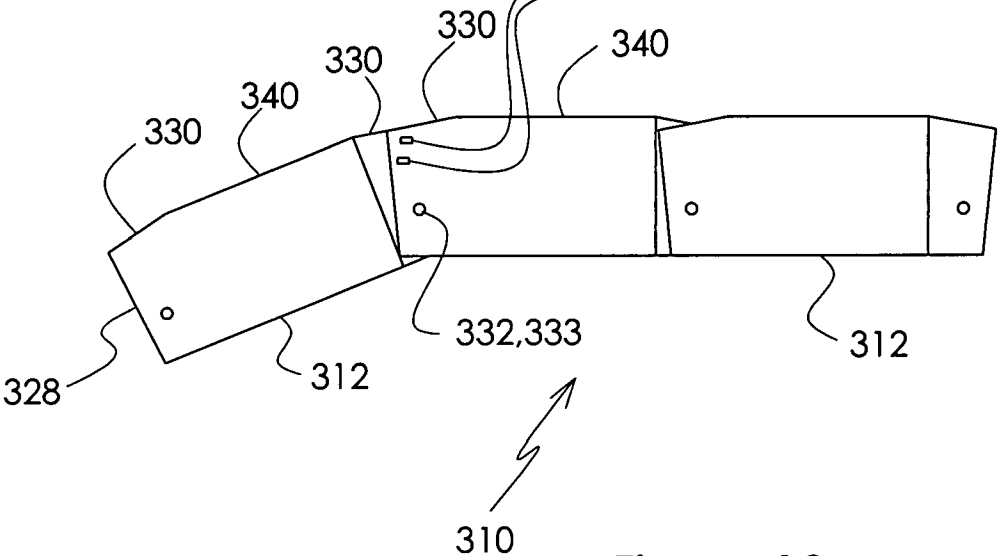

In another alternative embodiment depicted in FIGS. 17-19, the current invention includes a runner 310 for forming an archway. Runner 310 is preferably prepared from a single block of wood or injection molded plastic or other similar material. However, runner 310 may also be prepared from individual layers as discussed above.

The embodiment of FIGS. 17-19 differs from the prior disclosed embodiments in that sections 312 are designed to primarily for use in archways. Thus, runner 310 will not normally require the ability to form radii in two directions. In the depicted preferred embodiment, section 312 comprises a top surface 340 and a bottom surface (not shown). Additionally, sides 344 and 346 of section 312 carry a plurality of extensions 326.

As depicted side 344 carries four extensions 326 which define alternating gaps or recesses 320 and side 346 carries three extensions 326 defining recesses 320. Recesses 320 preferably have widths corresponding to the width of extensions 326. Additionally each extension 326 carries a passageway 332 which acts as a pivot point for adjacent sections 312. In the preferred embodiment a pin 333 or dowel rod or other similar device is received within passageway 332 to secure adjacent sections 312 to one another in a pivotal manner.

Since archways generally do not require radii in two directions, runner 310 can be designed to pivot in a single direction. As depicted in FIGS. 17-19, passageway 332 is located below the midpoint of runner 310. In addition to providing a runner which pivots in a single direction, offsetting passageway 332 also enhances the retentive strength of nail 35. Locating passageway below the midpoint of runner 310 increases the maximum distance nail 35 may be positioned away from passageway 332. As one skilled in the art will recognize, the increased distance between nail 35 and passageway 332 enhances the strength of the resulting joint between sections 312.

Preferably, as depicted in FIG. 17, end wall 328 of each extension 326 is shorter than the overall height—H—of section 312. By joining wall 328 to upper surface 340 by a sloping tangential wall or sloping surface 330, runner 310 provides an arch with a consistent radius of curvature lacking protruding corners when fixed on the desired radius.

Those skilled in the art will recognize that runner 310 can be modified to provide a runner capable of providing radii in at least two directions by moving passageway 332 to the vicinity of the midpoint or center line of section 312. Finally, as discussed above, and depicted in FIG. 23, passageway 332 may be omitted and adjacent sections 312 joined in a pivotal relationship by an elastomeric compound 37 such as foam rubber positioned within gaps 39.

The method for assembling runners 10, 210 and 310 and constructing a curved surface are essentially identical. Thus, the following description of preparing a curved surface will focus on the embodiment of FIGS. 1-16. In any of the above embodiments, when first end 26 of layer 14*b* is positioned within end 16 of an adjacent layer 14*b*, the radius of movement of adjacent sections is limited by tabs 22, 24 (or tabs 142, 148) and protrusion 28 or tabs 142, 148. Formation of runner 10 which provides a base or support for constructing a curved surface is accomplished by arranging a sufficient number of sections 12 in a manner depicted by FIG. 1. Sections 12 may be pivotally joined by either positioning a pin 33 in passageway 32 or by use of an elastomeric material such as foam rubber injected into gaps 39. Following positioning of sections 12 at the desired radius, adjacent sections are preferably secured to one another in this position by nailing through upper layer 14*a* of one section 12 into at least central layer 14*b* of an adjacent section 12 and preferably into layer 14*c*. Finally, assembly of individual sections 12 from layers 14 may be achieved by any conventional method such as but not limited to gluing or nailing.

Other embodiments of the current invention will be apparent to those skilled in the art from a consideration of this specification or practice of the invention disclosed herein. However, the foregoing specification is considered merely exemplary of the current invention with the true scope and spirit of the invention being indicated by the following claims.

I claim:

1. A runner for forming curved structures comprising:

at least two sections, each section having at least two layers, wherein said layers are substantially identical;

each layer having an upper surface, a lower surface, opposing side walls defining a first width, a first end and a second end, said first end having a concave recess; and, said second end having a convex portion, said convex portion defining a radial arc, wherein said convex portion is joined to said sidewalls by tangential walls, each tangential wall being an angled wall and said tangential walls define a second width that is less than the first width.

2. The runner of claim 1, wherein said section is assembled with at least one layer reversed in direction such that the convex portion of at least one layer is positioned opposite of and extends beyond the concave recess of another layer.

3. The runner of claim 1, wherein each section comprises at least three layers, wherein a second layer is sandwiched between a first layer and a third layer, said first and third layers are arranged symmetrically and said second layer is reversed in direction when compared to said first and third layers, said second end of said second layer extends beyond the first end of said first and third layers.

4. The runner of claim 1, wherein said sections are joined together in a pivotal relationship with said second end of one layer received in the first end of a layer of an adjacent section.

5. The runner of claim 1, further comprising a protrusion carried by said convex portion of said second end and at least two tabs carried by said first end, said protrusion and said tabs define the range of motion between adjacent sections.

6. A runner for forming curved structures comprising:

at least two sections, each section having at least two layers, wherein said layers are substantially identical;

each layer having an upper surface, a lower surface, opposing side walls defining a first width, a first end and a second end, said first end having a concave recess located between two tabs, said tabs joined to said sidewalls by tangential sidewalls; and, said second end having a convex portion, said convex portion defining a radial arc, wherein said convex portion is joined to said sidewalls by tangential walls, each tangential wall being an angled wall wherein said tangential walls joining said side walls to said convex portion define a second width that is less than the first width.

7. The runner of claim 6, wherein said section is assembled with at least one layer reversed in direction such that the convex portion of at least one layer is positioned opposite of and extends beyond the concave recess of another layer.

8. The runner of claim 6, wherein each section comprises at least three layers, wherein a second layer is sandwiched between a first layer and a third layer, said first and third layers are arranged symmetrically and said second layer is reversed in direction when compared to said first and third layers, said second end of said second layer extends beyond the first end of said first and third layers.

9. The runner of claim 6, wherein said sections are joined together in a pivotal relationship with said second end of one layer received in the first end of a layer of an adjacent section.

10. The runner of claim 6, farther comprising a protrusion carried by said convex portion, wherein the range of motion between sections is defined by said protrusion and said tabs carried by said first end.

11. A runner for forming curved structures comprising:

at least two sections, each section having at least three layers, wherein said layers are substantially identical;

each layer having an upper surface, a lower surface, opposing side walls, a first end and a second end, said first end having a concave recess located between two tabs, said tabs joined to said sidewalls by tangential sidewalls;

said second end having a convex portion, said convex portion defining a radial arc, wherein said convex portion is joined to said sidewalls by tangential walls;

a protrusion carried by said convex portion, wherein said protrusion and said tabs carried by said first end define the range of motion between sections; and, wherein at least one layer is offset from another layer and said offset layer is reversed such that said second end of said offset layer extends beyond said first end of at least one other layer and wherein said sections are joined together in a pivotal relationship with said second end of one layer received in the first end of a layer of an adjacent section.

* * * * *